US011651879B2

(12) United States Patent
Kang et al.

(10) Patent No.: US 11,651,879 B2
(45) Date of Patent: May 16, 2023

(54) FE-BASED SOFT MAGNETIC ALLOY AND METHOD FOR MANUFACTURING THE SAME

(71) Applicant: LG ELECTRONICS INC., Seoul (KR)

(72) Inventors: Dongwon Kang, Seoul (KR); Joungwook Kim, Seoul (KR); Jin Bae Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 233 days.

(21) Appl. No.: 16/659,133

(22) Filed: Oct. 21, 2019

(65) Prior Publication Data

US 2020/0135370 A1 Apr. 30, 2020

(30) Foreign Application Priority Data

Oct. 25, 2018 (KR) ..... 10-2018-0128495

(51) Int. Cl.
*H01F 1/153* (2006.01)
*C21D 6/00* (2006.01)
*C22C 45/02* (2006.01)

(52) U.S. Cl.
CPC ..... *H01F 1/15333* (2013.01); *C21D 6/00* (2013.01); *C22C 45/02* (2013.01); *H01F 1/15341* (2013.01); *C22C 2202/02* (2013.01)

(58) Field of Classification Search
None
See application file for complete search history.

(56) References Cited

U.S. PATENT DOCUMENTS

2010/0108196 A1 5/2010 Ohta et al.
2011/0272065 A1* 11/2011 Ohta ..... B82Y 25/00 148/540

FOREIGN PATENT DOCUMENTS

| | | | |
|---|---|---|---|
| CN | 101263240 | A | 9/2008 |
| CN | 101840763 | A | 9/2010 |
| CN | 102282633 | A | 12/2011 |
| CN | 102304669 | A | 1/2012 |
| CN | 102412045 | A | 4/2012 |
| CN | 102471856 | A | 5/2012 |
| JP | 2008231463 | A | 10/2008 |
| KR | 1020080077849 | A | 8/2008 |
| KR | 1020090113903 | A | 11/2009 |
| KR | 1020170087857 | A | 7/2017 |

* cited by examiner

*Primary Examiner* — Robert S Jones, Jr.
*Assistant Examiner* — Jiangtian Xu
(74) *Attorney, Agent, or Firm* — Dentons US LLP

(57) ABSTRACT

The present disclosure relates to an iron (Fe)-based amorphous soft magnetic alloy and a method for manufacturing the soft magnetic alloy. According to the present disclosure, there is provided an Fe-based soft magnetic alloy including C and S meeting $1 \geq a+b \geq 6$, wherein a is an atomic % content of C and b is an atomic % content of S, B meeting $4.5 \geq x \geq 13.0$, wherein x is an atomic % content of B, Cu meeting $0.2 \geq y \geq 1.5$, wherein y is an atomic % content of Cu, Al meeting $0.5 \geq z \geq 2$, wherein z is an atomic % content of Al, and a remaining atomic % content of Fe and other inevitable impurities, wherein the Fe-based soft magnetic alloy includes a micro-structure, and wherein the micro-structure includes a crystalline phase with a mean crystalline grain size ranging from 15 nm to 50 nm in an amorphous base.

9 Claims, 7 Drawing Sheets

FE-BASED SOFT MAGNETIC ALLOY AND METHOD FOR MANUFACTURING THE SAME

CROSS-REFERENCE TO RELATED APPLICATION

The present disclosure claims priority to and the benefit of Korean Patent Application No. 10-2018-0128495, filed on Oct. 25, 2018, the disclosure of which is incorporated herein by reference in its entirety.

BACKGROUND

1. Field of the Disclosure

The present disclosure relates to an iron (Fe)-based soft magnetic alloy and a method for manufacturing the Fe-based soft magnetic alloy.

2. Background

Soft magnetic materials are used in various transformers, choke coils, motors, electric generators, magnetic switches, sensors, and the like. Examples of soft magnetic materials widely in use include electric steel plates, permalloy, ferrite, or amorphous alloy.

Among such conventional soft magnetic materials, electric steel plates are economical and advantageously exhibit high magnetic flux density, but suffer from significant iron loss in high-frequency bands due to hysteresis and eddy currents. Electric steel plates exhibit high hysteresis and eddy currents as compared with amorphous alloy and, particularly, high iron loss even in low-frequency bands including commercial frequencies.

Meanwhile, Co-based amorphous alloy has low saturation magnetic flux density and poor thermal stability, requiring bulky parts or causes aging issues in high-power industry sectors.

In particular, for soft magnetic materials to be adopted as magnetic cores in motors, it is desirable that the soft magnetic materials have high magnetic flux density and low magnetic loss, and have easy processability during processing.

Attempts have been made to adopt iron (Fe)-based amorphous materials for enhanced magnetic properties.

However, conventional Fe-based amorphous materials are low in magnetic flux density and expose their limits when enhancing their properties. Furthermore, while slim materials are required to reduce loss due to eddy currents, conventional Fe-based amorphous alloy used as soft magnetic materials is not a proper candidate due to its tricky process for forming the same in thin ribbon shapes.

SUMMARY

The present disclosure aims to provide a Fe-based amorphous soft magnetic material that has enhanced saturation magnetic flux density, reduced iron loss, and a new composition and micro-structure by controlling its components and micro-structure.

Another object of the present disclosure is to provide an Fe-based amorphous soft magnetic material with a new composition and micro-structure which allows for better processability via slimming.

According to an embodiment of the present disclosure, there is provided an Fe-based soft magnetic alloy comprising C and S meeting $1 \geq a+b \geq 6$, wherein a is an atomic % content of C and b is an atomic % content of S, B meeting $4.5 \geq x \geq 13.0$, wherein x is an atomic % content of B, Cu meeting $0.2 \geq y \geq 1.5$, wherein y is an atomic % content of Cu, Al meeting $0.5 \geq z \geq 2$, wherein z is an atomic % content of Al, and a remaining atomic % content of Fe and other inevitable impurities, wherein the Fe-based soft magnetic alloy includes a micro-structure, and wherein the micro-structure includes a crystalline phase with a mean crystalline grain size ranging from 15 nm to 50 nm in an amorphous base so as to provide an Fe-based amorphous soft magnetic alloy with a micro-structure and a composition in which saturation magnetic flux density may be enhanced and iron loss may be reduced.

Preferably, a ratio of a to b may be (0.9 to 0.7):(0.1 to 0.3), and saturation magnetic flux density may be 1.71 T or more.

A coercive force of the alloy may be 2.25 Oe or less.

Preferably, the alloy may further include at least one of niobium (Nb), vanadium (V), and tantalum (Ta) which may partially substitute Cu. A proportion of Nb, V, or Ta substituting Cu may be 30% or less of the entire content of Cu.

Preferably, the alloy may further include silicon (Si) and/or phosphorus (P) which may partially substitute B. A proportion of Si or P substituting B may be 10% or less of the entire content of B.

According to an embodiment of the present disclosure, there may be provided a method for manufacturing an Fe-based soft magnetic alloy comprising melting an Fe-based mother alloy including C and S meeting $1 \geq a+b \geq 6$, wherein a is an atomic % content of C and b is an atomic % content of S, B meeting $4.5 \geq x \geq 13.0$, wherein x is an atomic % content of B, Cu meeting $0.2 \geq y \geq 1.5$, wherein y is an atomic % content of Cu, Al meeting $0.5 \geq z \geq 2$, wherein z is an atomic % content of Al, and a remaining atomic % content of Fe and other inevitable impurities, forming an amorphous micro-structure by quenching the melted mother alloy, and forming a crystalline phase by performing thermal treatment on the amorphous micro-structure, so as to manufacture an Fe-based amorphous soft magnetic alloy with a new composition and micro-structure by which material slimmability may be enhanced.

Preferably, among the components of the mother alloy, one or more compounds of $Al_2S_3$, $Cu_2S$, and FeS is added as a precursor to S.

Preferably, the melting may use arc re-melting or induction melting.

Preferably, forming the amorphous micro-structure may use melt-spinning at a spinning speed ranging from 50 m/s to 70 m/s.

In this case, the alloy produced by the melt-spinning may have a thickness ranging from 0.025 mm to 0.030 mm.

Preferably, forming the crystalline phase may maintain an argon (Ar)-pressurized atmosphere ranging from an atmospheric pressure to 0.3 MPa.

According to the present disclosure, the Fe-based soft magnetic alloy is allowed higher saturation magnetic flux density and lower coercive force by controlling the composition and micro-structure of the alloy. Thus, the Fe-based soft magnetic alloy of the present disclosure contributes to making electronic devices compact while securing high inductance.

A micro-structure with nano-sized crystalline phases may be formed in the amorphous base by controlling the manufacturing method and the composition of the alloy, thereby reducing eddy currents and hence iron loss.

Further, material processability may be secured via slimming into ribbon shapes by controlling the composition and manufacturing method of the alloy.

The Fe-based soft magnetic alloy of the present disclosure may prevent iron loss due to eddy currents in motors or other electronic devices.

DETAILED DESCRIPTION OF EXEMPLARY EMBODIMENTS

Figure 1:
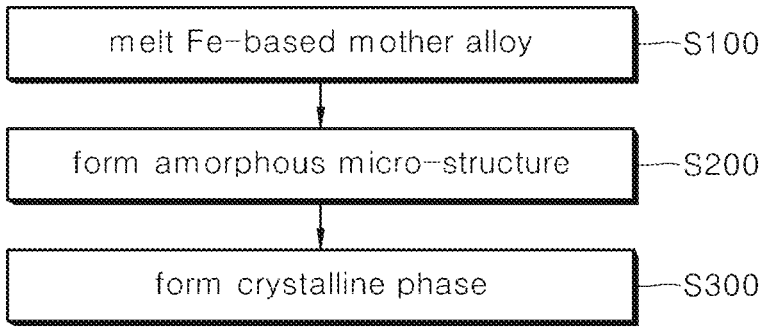
FIG. 1 is a flow diagram schematically illustrating a method for manufacturing Fe-based amorphous soft magnetic alloy according to the present disclosure.

Hereinafter, a soft magnetic alloy and a method for manufacturing the same, according to embodiments of the present disclosure, are described in detail with reference to the accompanying drawings.

However, the present disclosure is not limited to the embodiments disclosed herein, and various changes may be made thereto. The embodiments disclosed herein are provided only to inform one of ordinary skilled in the art of the category of the present disclosure. The scope of the present disclosure is defined by the appended claims.

For clarity of the disclosure, irrelevant parts are removed from the drawings, and similar reference denotations may be used to refer to similar elements throughout the specification. The same or substantially the same reference denotations may be used to refer to the same or substantially the same elements throughout the specification and the drawings. Description of the known art or functions may be skipped when it is determined that the description may obscure rather than aid in the understanding of the present disclosure.

Such denotations as "first," "second," "A," "B," "(a)," and "(b)," may be used in describing the components of the present disclosure. These denotations are provided merely to distinguish a component from another, and the essence of the components is not limited by the denotations in light of order or sequence. When a component is described as "connected," "coupled," or "linked" to another component, the component may be directly connected or linked to the other component, but it should also be appreciated that other components may be "connected," "coupled," or "linked" between the components.

For illustration purposes, each components may be divided into sub-components. However, the components may be implemented in the same device or module, or each component may be separately implemented in a plurality of devices or modules.

Fe-Based Amorphous Soft Magnetic Alloy

According to the present disclosure, iron (Fe)-based amorphous soft magnetic alloy may be expressed as $Fe_{100-a-b-x-y-z}C_aS_bB_xCu_yAl_z$. The Fe-based amorphous soft magnetic alloy preferably includes Fe as the base and, carbon (C), sulfur (S), boron (B), copper (Cu), and aluminum (Al) as other elements.

Iron (Fe)

Fe is the element that mostly occupies the amorphous soft magnetic alloy. When Fe meets $Fe_{100-a-b-x-y-z}C_aS_bB_xCu_yAl_z$ atomic %, the Fe-based amorphous soft magnetic alloy of the present disclosure may have high saturation magnetic flux density and superior processability. Preferably, when Fe meets 78 atomic % to 86 atomic %, the Fe-based amorphous soft magnetic alloy of the present disclosure may secure both superior magnetic flux density and processability. If the content of Fe is less than 78 atomic %, the saturation magnetic flux density feature of the alloy may deteriorate. In contrast, if the content of Fe is more than 86 atomic %, the alloy may hardly form an amorphous micro-structure even with melt-spinning and its processability may deteriorate.

Carbon (C)

Generally, C is a strong austenite stabilizing element in the Fe alloy system and is a cheap element that aids in cost savings. In the Fe-based amorphous soft magnetic alloy of the present disclosure, C contributes to formation of an amorphous micro-structure. Although C may not play a significant role in amorphization of Fe-based amorphous soft magnetic alloy of the present disclosure as compared with S, it is still an essential element in amorphization. As predictable from the Fe—C phase diagram, addition of C may reduce the liquidus line temperature of the Fe-based amorphous soft magnetic alloy of the present disclosure, expanding the stable temperature scope where the liquid phase is stable and hence raising the amorphization of the alloy.

However, when the mother alloy is melted, part of C as compared with the added content of C is volatilized, such that composition deviation may occur. Thus, the content of C actually added to the mother alloy may preferably be 20% more as compared with the content of C contained in the final Fe-based amorphous soft magnetic alloy. By so doing, in the content of C in the final Fe-based amorphous soft magnetic alloy, the actual and nominal compositions may be rendered substantially identical to each other.

Sulfur (S)

S enhances the saturation magnetic flux density of the Fe-based amorphous soft magnetic alloy and contributes to the growth of the crystalline phases precipitated in the amorphous base when subsequent thermal treatment is performed. In particular, the size of nano-sized crystal precipitated in the amorphous base of the Fe-based amorphous soft magnetic alloy may be adjusted depending on the content of S added. S may also enhance processability required to form the Fe-based amorphous soft magnetic alloy into a final product. However, if S is excessively contained in the Fe-based amorphous soft magnetic alloy, it may prompt crystallization when the mother alloy of the Fe-based amorphous soft magnetic alloy is melted, obstructing formation of an amorphous base in the mother alloy.

According to the present disclosure, the amount of S added in the Fe-based amorphous soft magnetic alloy is determined considering the amount of C added, in light of that S substitutes C and dissolves in Fe. Specifically, the sum of the content "b" of S and the content "a" of C for the Fe-based amorphous soft magnetic alloy of the present disclosure is preferably 1 atomic % to 6 atomic %. If the content a+b is less than 1 atomic %, the amorphization of the Fe-based amorphous soft magnetic alloy may deteriorate, rendering it difficult to form an amorphous micro-structure. On the contrary, if the content a+b is more than 6 atomic %, the mechanical brittleness of the Fe-based amorphous soft magnetic alloy may increase due to excessive addition of the interstitial element, resulting in poor processability.

Further, the proportion of S which substitutes C in the Fe-based amorphous soft magnetic alloy of the present disclosure is preferably 30% or less of the overall content of C. If the proportion of S replacing C exceeds 30% of the entire content of C, excessive addition of S may lower the amorphization of the base of the Fe-based amorphous soft magnetic alloy and, as a result, turns the base of the soft magnetic alloy into a crystalline phase, and may probably cause iron loss due to hysteresis loss.

Boron (B)

B is an element essential in enhancing the amorphization and saturation magnetic flux density property of the Fe-based amorphous soft magnetic alloy of the present disclosure.

The content x of B in the Fe-based amorphous soft magnetic alloy of the present disclosure is preferably 4.5 atomic % to 13.0 atomic %. If the content x is less than 4.5 atomic %, the amorphization of the Fe-based amorphous soft magnetic alloy may deteriorate, rendering it difficult to form an amorphous micro-structure and to secure soft magnetic property even after thermal treatment. In contrast, if the content x is more than 13.0 atomic %, the saturation magnetic flux density of the Fe-based amorphous soft magnetic alloy of the present disclosure may be lowered. Further, if the content x is more than 13.0 atomic %, the nano crystalline phase may not uniformly grow due to formation of B-rich phase when nano crystals grow in the amorphous base.

Copper (Cu)

Cu is an inevitable element in nano crystalline growth and, absent Cu, a nano crystalline phase may be hard to form in the amorphous base of the Fe-based amorphous soft magnetic alloy of the present disclosure.

The content y of Cu in the Fe-based amorphous soft magnetic alloy of the present disclosure is preferably 0.2 atomic % to 1.5 atomic %. If the content y is less than 0.2 atomic %, nano crystallization in the amorphous base of the alloy of the present disclosure may be rendered difficult. In contrast, if the content y is more than 1.5 atomic %, it may be difficult to obtain a desired size of nano crystals due to coarsened nano crystals, and further, the soft magnetic property may easily deteriorate.

Aluminum (Al)

Al is an essential element that advantageously advances the amorphization of the Fe-based amorphous soft magnetic alloy of the present disclosure. However, the amorphization of Al is relatively low as compared with other elements, such as B.

The content z of Al in the Fe-based amorphous soft magnetic alloy of the present disclosure is preferably 0.5 atomic % to 2.0 atomic %. If the content z is less than 0.5 atomic %, the amorphization of the alloy of the present disclosure may be significantly lowered. In contrast, if the content z is more than 2.0 atomic %, it may combine with other components in the Fe-based amorphous soft magnetic alloy of the present disclosure, increasing the likelihood of crystallization.

Other Elements

The Fe-based amorphous soft magnetic alloy of the present disclosure may include components other than those described above, as necessary.

Among the group 5 transition metals, niobium (Nb), vanadium (V), and tantalum (Ta) may be included in the Fe-based amorphous soft magnetic alloy of the present disclosure. The transition metals may partially substitute Cu and perform some of the functions of Cu which forms nano crystalline grains in the amorphous base.

However, the content of the transition metals should not exceed 20% of the whole content y of Cu added. If the content of the transition metals exceeds 20% of the entire content of Cu, the transition metals may react with other elements, e.g., C and S, contained in the Fe-based amorphous soft magnetic alloy of the present disclosure in addition to forming nano crystalline grains, and may be highly likely to form a carbide or sulfide.

Further, the Fe-based amorphous soft magnetic alloy of the present disclosure may add silicon (Si) and phosphorus (P). Si and P may be added to enhance amorphization and saturation magnetic flux density and they may partially substitute B.

In this case, the proportion of Si substituting B is preferably 30% or less of the entire amount of B added, and the proportion of P substituting B is preferably 10% or more of the entire amount of B added. If the proportions of Si and P supplementing B depart from these values, the amorphization of the Fe-based amorphous soft magnetic alloy of the present disclosure may deteriorate.

Method of Manufacturing Fe-Based Amorphous Soft Magnetic Alloy

FIG. 1 is a flow diagram schematically illustrating a method for manufacturing Fe-based amorphous soft magnetic alloy according to the present disclosure.

Referring to FIG. 1, a method for manufacturing an alloy according to the present disclosure includes the steps of melting an Fe-based mother alloy including C, S, B, Cu, and Al, Fe, and other inevitable impurities, wherein the atomic % content a of C and the atomic % content b of S meet: $1 \geq a+b \geq 6$, the atomic % content x of B meets: $4.5 \geq x \geq 13.0$, and the atomic % content y of Cu meets: $0.2 \geq y \geq 1.5$, the atomic % content z of Al meets: $0.5 \geq z \geq 2$; quenching the melted mother alloy to form an amorphous micro-structure; and thermally treating the amorphous micro-structure to form a nano crystalline phase.

First, the step of melting the mother alloy of the present disclosure may include uniformly melting all the components of the Fe-based amorphous soft magnetic alloy. However, S contained in the alloy of the present disclosure may be highly volatile so it may not readily melt in the final mother alloy. The volatility of S may prevent the alloy from achieving its targeted composition range.

To melt (or dissolve) S in the mother alloy of the present disclosure, the manufacturing method of the present disclosure uses powdered or grained S or one or more compounds of $Al_2S_3$, $Cu_2S$, and FeS as a precursor of S.

To uniformly and completely melt S, the manufacturing method of the present disclosure may adopt arc re-melting or induction melting that may produce the mother alloy in the argon (Ar) gas pressurized atmosphere.

Next, the alloy manufacturing method of the present disclosure may include forming an amorphous micro-structure by quenching the melted mother alloy.

Although melt-spinning may be used to form an amorphous micro-structure in the manufacturing method according to an embodiment, the amorphization of the present disclosure is not necessarily limited to melt-spinning. For example, as non-limiting examples, metal solidification or mechanical alloying may also be adopted in the amorphization step of the present disclosure.

However, melt-spinning may enable formation of thin ribbon shapes as the final product. To minimize iron loss due to eddy currents, which may be an issue arising for soft magnetic metals, the product should be thin. Thus, melt-spinning may be very appropriate for manufacturing thin amorphous alloy as compared with other processes and advantageously work to enhance the magnetic property of the final product.

The melt-spinning step in the manufacturing method of the present disclosure may manufacture the Fe-based amorphous soft magnetic metal which is 0.025 mm to 0.030 mm thick in a stable manner by adjusting the spinning speed to 50 m/s to 70 m/s. In other words, the Fe-based amorphous soft magnetic alloy with the composition ranges of the present disclosure may secure stabilized processability under the melt-spinning conditions due to its compositional property. If the spinning speed is lower than 50 m/s, the cooling of the melt may slow down, causing it difficult for the final micro-structure to be amorphous. In contrast, if the spinning speed is higher than 70 m/s, the amount of the melt that meets the spinning may reduce, resulting in the final, cooled-down amorphous alloy being too thin.

Figure 2:
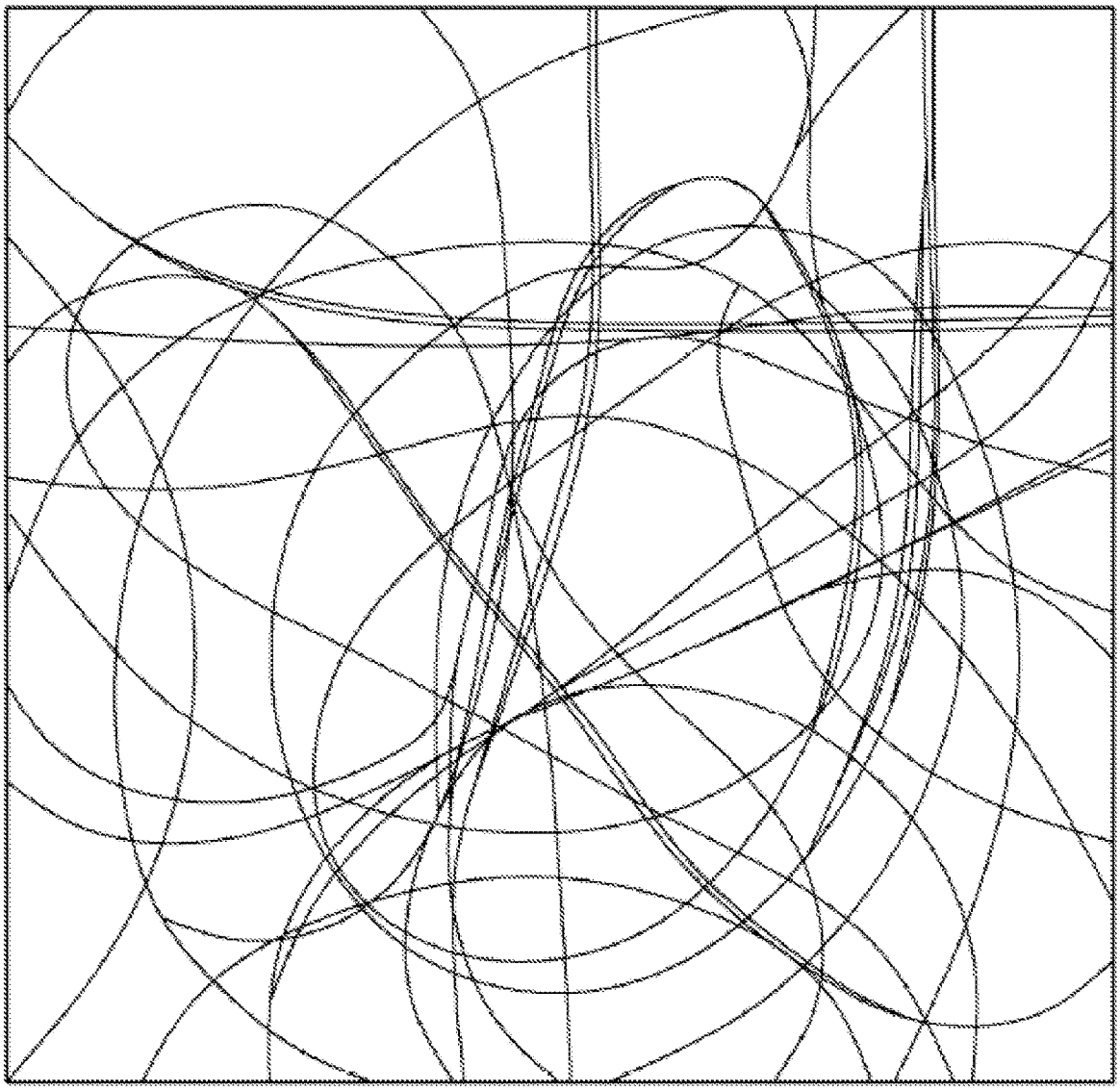
FIG. 2 is a view illustrating a ribbon shape of Fe-based amorphous soft magnetic alloy amorphized by melt-spinning after a mother alloy is prepared by arc-melting, according to the present disclosure.

FIG. 2 is a view illustrating a ribbon shape of Fe-based amorphous soft magnetic alloy amorphized by melt-spinning after a mother alloy is prepared by arc-melting, according to the present disclosure. Table 1 below represents the micro-structure, saturation magnetic flux density, and coercive force depending on composition ranges for embodiments meeting the composition ranges of the Fe-based amorphous soft magnetic alloy of the present disclosure.

Referring to FIG. 2, the manufacturing method of the present disclosure is shown to be adequate for producing ribbons with a macroscopically stable and uniform micro-structure. In other words, FIG. 2 proves that the components, composition ranges, and manufacturing method of alloy of the present disclosure are very effective in allowing for Fe-based amorphous soft magnetic alloy processability.

TABLE 1

Characteristics depending on composition ranges of Fe-based amorphous soft magnetic alloy

| Composition | Fe | x | y | z | a | b | Remarks | Bs(T) | Hci(Oe) |
|---|---|---|---|---|---|---|---|---|---|
| Comparison Example 1 | 84 | 13.5 | 1 | 0.5 | 1 | 0 | amorphous | 1.45 | 0.425 |
| Comparison Example 2 | 93.5 | 4 | 1 | 0.5 | 1 | 0 | crystallization | — | — |
| Embodiment 1 | 86 | 12 | 1 | 0 | 1 | 0 | amorphous | 1.55 | 0.684 |
| Embodiment 2 | 85.5 | 12 | 1 | 0.5 | 1 | 0 | amorphous | 1.52 | 0.4746 |
| Embodiment 3 | 85 | 12 | 1 | 1 | 1 | 0 | amorphous | 1.51 | 1.11 |
| Embodiment 4 | 85.5 | 12 | 1 | 0.5 | 0.9 | 0.1 | amorphous | 1.62 | 0.985 |
| Embodiment 5 | 85.5 | 12 | 1 | 0.5 | 0.8 | 0.2 | amorphous | 1.62 | 1.25 |
| Embodiment 6 | 85.5 | 12 | 1 | 0.5 | 0.7 | 0.3 | amorphous | 1.65 | 1.35 |
| Embodiment 7 | 85 | 12 | 1 | 0.5 | 1.4 | 0.1 | amorphous | 1.57 | 1.1 |
| Embodiment 8 | 85 | 12 | 1 | 0.5 | 1.3 | 0.2 | amorphous | 1.59 | 1.22 |
| Embodiment 9 | 85 | 12 | 1 | 0.5 | 1.2 | 0.3 | amorphous | 1.62 | 1.57 |

As shown in Table 1, the Fe-based amorphous soft magnetic alloy of the present disclosure exhibits deteriorated amorphization if the content x of B is less than 4.5 (Comparison Example 2), and the resultant micro-structures fails to have an amorphous base even via melt-spinning. In contrast, if the content x of B in the Fe-based amorphous soft magnetic alloy of the present disclosure is more than 13.0, the saturation magnetic flux density is less than 1.5 T so that its magnetic property may deteriorate.

On the contrary, the embodiments meeting the composition range in the alloy of the present disclosure are observed to present superior saturation magnetic flux density of 1.5 T or more simply via melt-spinning but without subsequent thermal treatment.

The magnetic properties in embodiments 2 and 3 and other embodiments directly show an influence of S on the saturation magnetic flux density of the Fe-based amorphous soft magnetic alloy of the present disclosure. In other words, if the Fe-based amorphous soft magnetic alloy adds S, the saturation magnetic flux density of the alloy may increase significantly.

Figure 3:
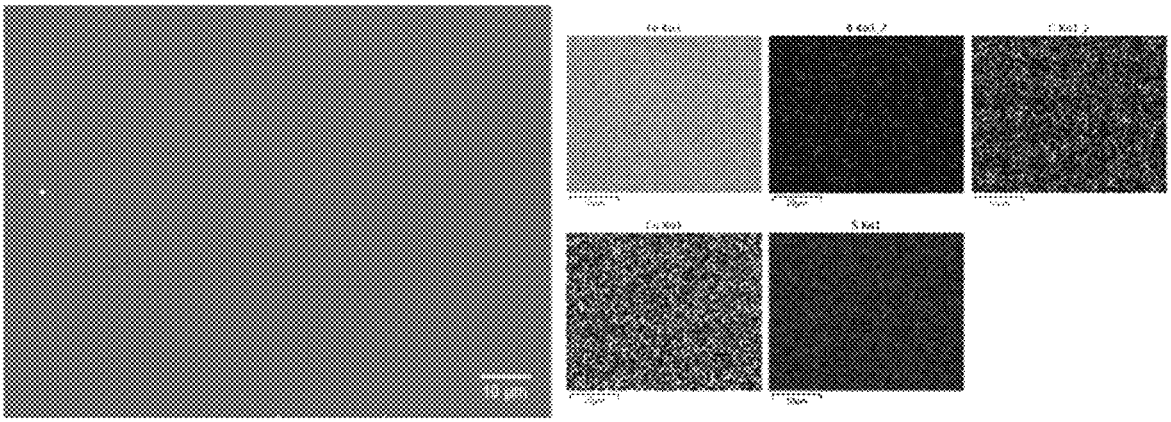
FIG. 3 is a view illustrating the result of analysis obtained by amorphizing amorphous soft magnetic alloy with a composition by melt-spinning and then energy dispersive spectroscopy (EDS)-mapping major components, according to an embodiment of the present disclosure.
Figure 4:
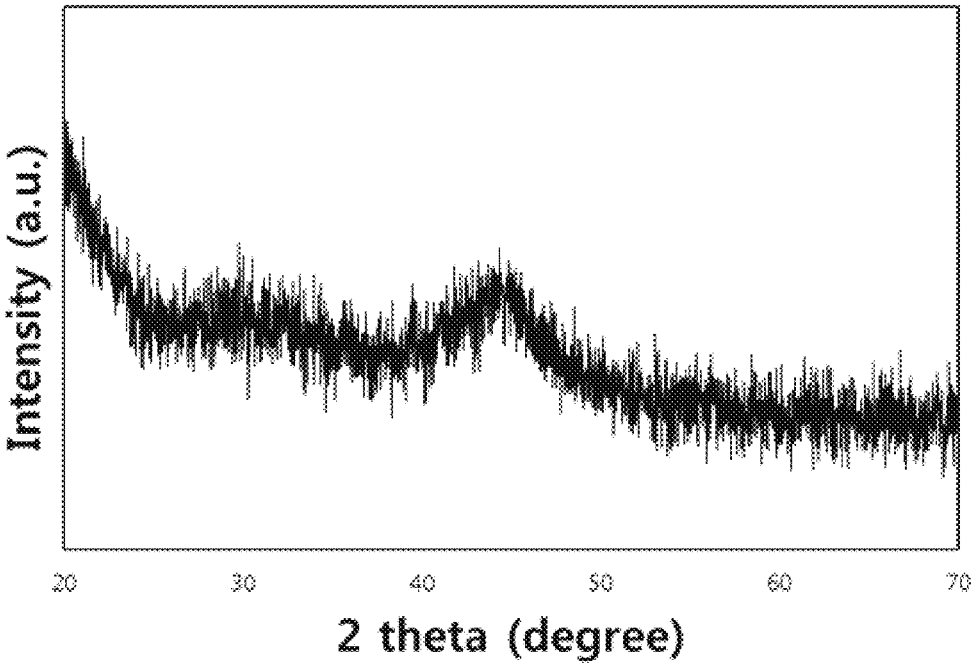
FIG. 4 is a chart illustrating the result of x-ray diffraction (XRD) analysis after amorphizing amorphous soft magnetic alloy with a composition by melt-spinning, according to an embodiment of the present disclosure.

FIGS. 3 and 4 illustrate the results of energy dispersive spectroscopy (EDS) mapping and x-ray diffraction (XRD) analysis of embodiment 5 in Table 1 above.

As the EDS results show in FIG. 3, the Fe-based amorphous soft magnetic alloy, after melt-spinning, has a micro-structure in which all of the components are uniformly distributed.

FIG. 4 shows that the Fe-based amorphous soft magnetic alloy of the present disclosure has diffuse X-ray diffraction peaks. The XRD results of FIG. 4 may directly prove that the Fe-based amorphous soft magnetic alloy with the composition of the present disclosure has an amorphous base.

To mitigate iron loss by reducing eddy currents in the amorphous soft magnetic alloy, the manufacturing method of the present disclosure may add subsequent thermal treatment after melt-spinning. The subsequent thermal treatment may be a process for forming a crystalline phase in the amorphous base. In this case, a maintaining temperature of the subsequent thermal treatment preferably may have a temperature range which is about 50° C. higher than the crystallization temperature at which the crystalline phase of the Fe-based amorphous soft magnetic alloy of the present disclosure, which has the composition according to each embodiment, is precipitated as measured via differential thermal analysis (DTA) analysis. The temperature range is a condition for ensuring complete creation of a crystalline phase in the Fe-based amorphous soft magnetic alloy of the present disclosure during an industrial time. Specific processing conditions may include a heating rate of 15° C./min, a maintaining temperature from 350° C. to 500° C., and a maintaining time from 30 minutes to 60 minutes. If the subsequent thermal treatment temperature is lower than 350° C., crystalline growth may not occur so that the subsequent thermal treatment may not take effect. In contrast, if the subsequent thermal treatment is higher than 500° C., the crystalline phase may overly coarsen, leading to a sharp rise in coercive force.

Meanwhile, to prevent S from volatilizing during subsequent thermal treatment, the thermal treatment preferably remains in an Ar-pressurized atmosphere from the atmosphere pressure to 0.3 MPa. If the pressure in the subsequent thermal treatment exceeds 0.3 MPa, uniform growth of nano-sized crystalline grains may be rendered difficult, and thermal treatment may rather deteriorate the magnetic property.

Figure 5:
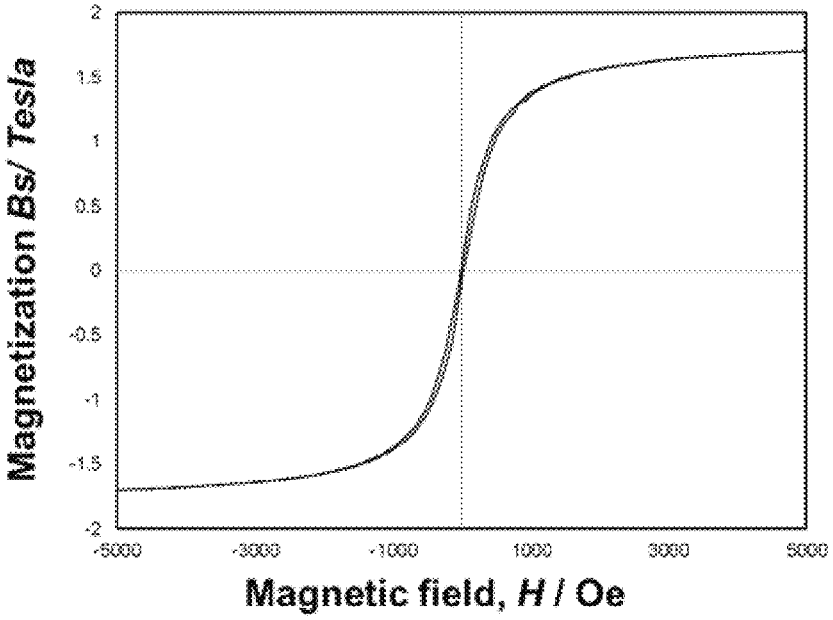
FIG. 5 is a chart illustrating the result of measurement by a vibrating sample magnetometer (VSM) after performing subsequent thermal treatment on Fe-based amorphous soft magnetic alloy with a composition according to an embodiment of the present disclosure.

FIG. 5 is a chart illustrating the result of measurement by a vibrating sample magnetometer (VSM) after performing subsequent thermal treatment on Fe-based amorphous soft magnetic alloy with the composition of embodiment 5 in Table 1. It shows that the saturation magnetic flux density of the Fe-based amorphous soft magnetic alloy with the composition of embodiment 5 of the present disclosure is enhanced up to 1.7 T by subsequent thermal treatment.

Table 2 below represents the micro-structure, saturation magnetic flux density, and coercive force depending on composition ranges after performing subsequent thermal treatment on the Fe-based amorphous soft magnetic alloy of the embodiments in Table 1. The embodiments meeting the composition range in the alloy of the present disclosure are observed to present superior saturation magnetic flux density of 1.6 T or more after subsequent thermal treatment. In particular, it can be shown that the alloy according to the embodiments where S is added presents a way high saturation magnetic flux density of 1.7 T or more as compared with the alloy according to the embodiments where only C is added. It may be verified that the embodiments in which both S and C are added and S substitutes C, although their exact mechanism is not known, produce the effects of enhancing the processability and adjusting the nano crystalline grains in the amorphous substance by S substitution as compared with the conventional art or embodiments where C alone is added.

TABLE 2

Characteristics depending on composition ranges of Fe-based amorphous soft magnetic alloy after subsequent thermal treatment

| Composition | thermal treatment temperature (° C.) | crystalline grain size (nm) | Bs(T) | Hci(Oe) |
|---|---|---|---|---|
| Embodiment 1 | 380 | 35 | 1.65 | 1.651 |
| Embodiment 2 | 390 | 30 | 1.67 | 1.451 |
| Embodiment 3 | 395 | 30 | 1.62 | 1.88 |
| Embodiment 4 | 390 | 45 | 1.74 | 2.15 |
| Embodiment 5 | 390 | 50 | 1.71 | 1.99 |
| Embodiment 6 | 390 | 50 | 1.78 | 2.22 |
| Embodiment 7 | 390 | 45 | 1.75 | 2.65 |
| Embodiment 8 | 390 | 45 | 1.81 | 2.45 |
| Embodiment 9 | 390 | 45 | 1.79 | 2.64 |

Figure 6:
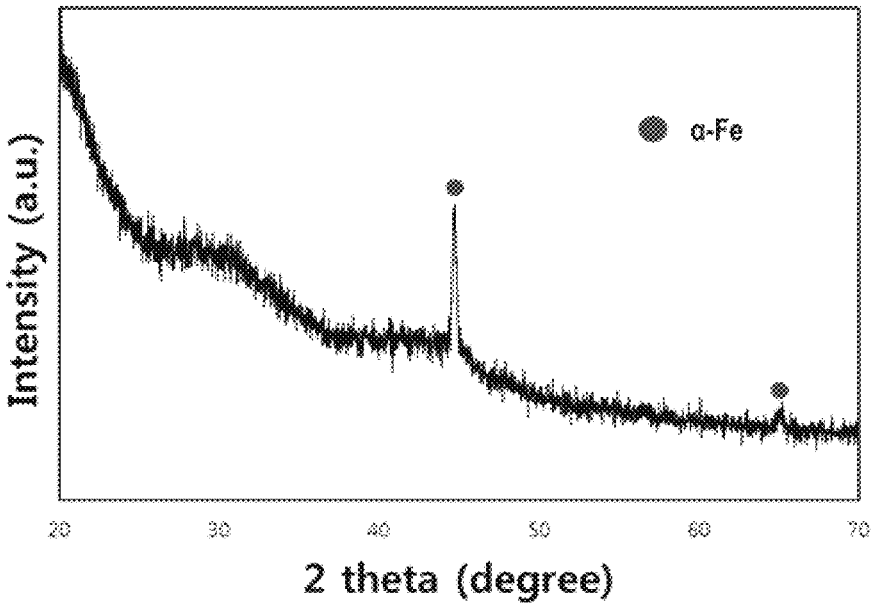
FIG. 6 is a chart illustrating the result of XRD analysis after amorphizing and then thermally treating amorphous soft magnetic alloy with a composition according to an embodiment of the present disclosure.
Figure 7:
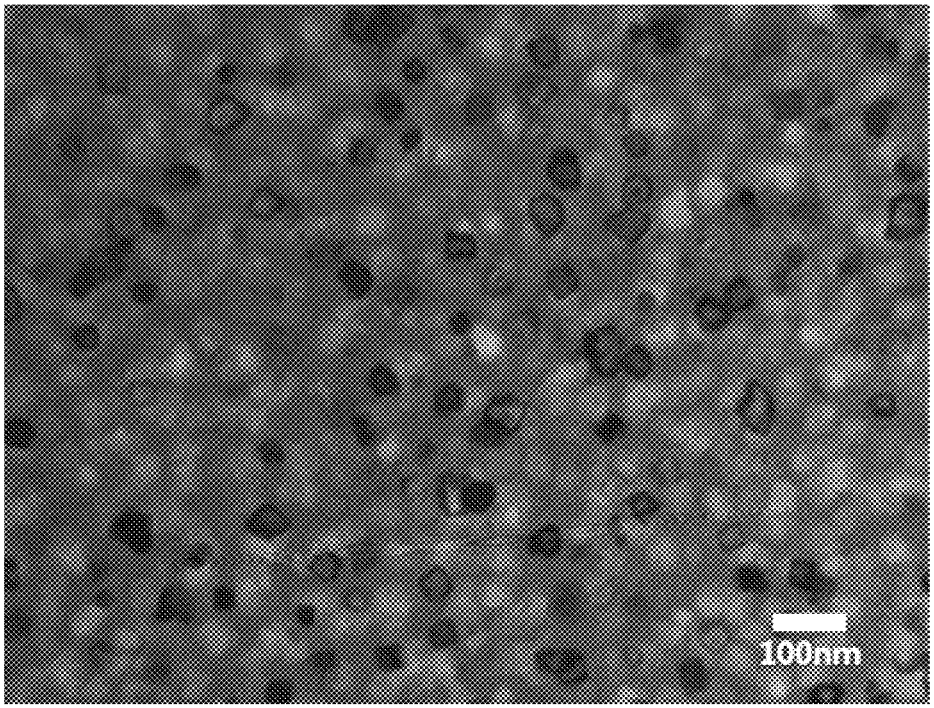
FIG. 7 is a photo obtained by observing the microstructure via transmission electron microscopy (TEM) after amorphizing and then thermally treating amorphous soft magnetic alloy with a composition according to an embodiment of the present disclosure.

FIGS. 6 and 7 respectively illustrate the result of XRD analysis of embodiment 5 in Table 2 and a transmission electron microscopy (TEM) photo of the micro-structure.

The XRD result of FIG. 6 has different properties than those of the XRD result of FIG. 4. In the XRD result, peak typically means that a crystalline phase exists in the micro-structure of a sample under test. From the XRD result of FIG. 6, a plurality of peaks are observed, and the peaks have been inspected to correspond to a ferrite crystalline structure of body-centered cubic lattice (bcc). As a result, the XRD result of FIG. 6 directly shows that a crystalline ferrite phase is created in the amorphous base upon performing subsequent thermal treatment on the Fe-based amorphous soft magnetic alloy with the composition of the present disclosure.

FIG. 7 is a TEM photo that shows the micro-structure of the Fe-based amorphous soft magnetic alloy with the composition of the present disclosure, according to embodiment 5. As shown in the TEM photo of FIG. 7, the micro-structure of the Fe-based amorphous soft magnetic alloy includes nano-sized crystalline phases in the amorphous base.

The size of the crystalline grain in the crystalline phase preferably ranges from 15 nm to 50 nm. If the size of the crystalline grain in the crystalline phase is smaller than 15 nm, eddy currents may increase, significantly increasing iron loss. If the size of the crystalline grain in the crystalline phase is larger than 50 nm, coercive force (magnetic coercive force) significantly increases and, thus, increases the brittleness of the steel plate, with the result of poor process ability.

While the present disclosure has been shown and described with reference to exemplary embodiments thereof, it will be apparent to those of ordinary skill in the art that various changes in form and detail may be made thereto without departing from the spirit and scope of the present disclosure as defined by the following claims. Further, although operations and effects according to the configuration of the present disclosure are not explicitly described in the foregoing detailed description of embodiments, it is apparent that any effects predictable by the configuration also belong to the scope of the claims.

What is claimed is:

1. An iron (Fe)-based soft magnetic alloy, comprising:

carbon (C) and sulfur (S) meeting $1 \leq a+b \leq 1.5$, wherein a is an atomic % content of C and b is an atomic % content of S, wherein b is $0 < b \leq 0.3$;

boron (B) meeting $4.5 \leq x \leq 13.0$, wherein x is an atomic % content of B;

copper (Cu) meeting $0.2 \leq y \leq 1.5$, wherein y is an atomic % content of Cu;

aluminum (Al) meeting $0.5 \leq z \leq 2$, wherein z is an atomic % content of Al; and a remaining atomic % content of Fe and other inevitable impurities, wherein the Fe-based soft magnetic alloy includes a micro-structure, and wherein the micro-structure includes a crystalline phase with an average grain size ranging from 15 nm to 50 nm in an amorphous base.

2. The Fe-based soft magnetic alloy of claim 1, wherein saturation magnetic flux density is 1.71 T or more.

3. The Fe-based soft magnetic alloy of claim 2, wherein a coercive force of the alloy is 2.25 Oe or less.

4. The Fe-based soft magnetic alloy of claim 1, further comprising at least one of niobium (Nb), vanadium (V), and tantalum (Ta) which partially substitute Cu.

5. The Fe-based soft magnetic alloy of claim 4, wherein a proportion of Nb, V, or Ta substituting Cu is 20% or less of the entire content of Cu.

6. The Fe-based soft magnetic alloy of claim 1, further comprising silicon (Si) and/or phosphorus (P) which partially substitute B.

7. The Fe-based soft magnetic alloy of claim 6, wherein a proportion of Si substituting B is 30% or less of the entire content of B.

8. The Fe-based soft magnetic alloy of claim 6, wherein a proportion of P substituting B is 10% or less of the entire content of B.

9. The Fe-based soft magnetic alloy of claim 1, wherein the average grain size of the crystalline phase ranges from 30 nm to 50 nm.

* * * * *